US009285122B2

(12) United States Patent
Jones et al.

(10) Patent No.: US 9,285,122 B2
(45) Date of Patent: Mar. 15, 2016

(54) FUEL INJECTOR

(75) Inventors: Steven P. Jones, Bristol (GB); Stephen C. Harding, Bristol (GB)

(73) Assignee: ROLLS-ROYCE plc, London (GB)

( * ) Notice: Subject to any disclaimer, the term of this patent is extended or adjusted under 35 U.S.C. 154(b) by 766 days.

(21) Appl. No.: 13/544,224

(22) Filed: Jul. 9, 2012

(65) Prior Publication Data

US 2013/0020413 A1 Jan. 24, 2013

(30) Foreign Application Priority Data

Jul. 20, 2011 (GB) ..... 1112434.4

(51) Int. Cl.

| | |
|---|---|
| ***B05B 7/10*** | (2006.01) |
| ***F23R 3/28*** | (2006.01) |
| ***F23R 3/34*** | (2006.01) |
| ***B05B 1/26*** | (2006.01) |
| ***B05B 7/06*** | (2006.01) |
| ***F23D 11/38*** | (2006.01) |
| ***F23R 3/14*** | (2006.01) |

(52) U.S. Cl.

CPC . *F23R 3/286* (2013.01); *B05B 1/26* (2013.01); *B05B 1/262* (2013.01); *B05B 7/06* (2013.01); *B05B 7/10* (2013.01); *F23D 11/383* (2013.01); *F23R 3/14* (2013.01); *F23R 3/343* (2013.01); *F23D 2900/11101* (2013.01)

(58) Field of Classification Search

CPC ..... F23R 3/343; F23R 3/286; F23R 3/14; F23D 2900/11101; F23D 11/383; B05B 1/26; B05B 1/262; B05B 7/06; B05B 7/10

USPC ..... 239/403–406, 423, 424, 461, 502; 60/737, 740

See application file for complete search history.

(56) References Cited

U.S. PATENT DOCUMENTS

| | | | | |
|---|---|---|---|---|
| 7,266,945 | B2 * | 9/2007 | Sanders | 60/743 |
| 7,878,000 | B2 * | 2/2011 | Mancini et al. | 60/737 |
| 8,327,643 | B2 * | 12/2012 | Yamamoto et al. | 239/403 |
| 2003/0141383 | A1 | 7/2003 | Hayashi | |
| 2010/0308135 | A1 | 12/2010 | Yamamoto et al. | |

FOREIGN PATENT DOCUMENTS

| | | |
|---|---|---|
| EP | 1 391 653 A2 | 2/2004 |
| EP | 2 037 172 A2 | 3/2009 |

OTHER PUBLICATIONS

Dec. 4, 2012 Search Report issued in European Patent Application No. 12 17 5518.

Nov. 8, 2011 Search Report issued in British Patent Application No. GB1112434.4.

* cited by examiner

*Primary Examiner* — Steven J Ganey

(74) *Attorney, Agent, or Firm* — Oliff PLC

(57) ABSTRACT

A fuel injector comprising: a prefilmer; a plurality of discrete fuel sources each arranged to supply fuel to a surface of the prefilmer; wherein the prefilmer comprises circumferential dispersion structure which, in use, spreads the fuel in a circumferential direction as it passes from an impingement point on the surface of the prefilmer to a downstream edge of the prefilmer.

14 Claims, 3 Drawing Sheets

FUEL INJECTOR

The present invention relates to a fuel injector, and particularly but not exclusively to a fuel injector having a prefilmer which provides a uniform circumferential fuel distribution.

BACKGROUND

FIGS. 1 and 2 show a conventional fuel injector 2. The injector 2 comprises a pilot injector 4 and a pilot swirler 6 for swirling air past the pilot injector 4. A main injector 8 is concentrically positioned around the pilot injector 4 and the pilot swirler 6. An inner main swirler 10 and an outer main swirler 12 are disposed on concentrically inner and outer sides of the main injector 8.

An inner annular member 14 is located between the pilot swirler 6 and the inner main swirler 10. Similarly, an outer annular member 16 is located between the inner main swirler 10 and the outer main swirler 12.

The main injector 8 comprises a plurality of discrete fuel sources (not shown) which are spaced around the circumference of an outer surface of the inner annular member 14. As indicated by the dashed lines, the fuel sources direct jets of fuel towards an inner surface of the outer annular member 16, which forms a prefilmer 18. Alternatively, the fuel may be placed on the prefilmer 18 using a series of discrete slots located around the circumference of the prefilmer 18.

The fuel flows over the surface of the prefilmer 18 prior to being shed from a downstream edge 20 into the swirling airflows. This allows effective atomisation of the fuel.

In an alternative arrangement, the fuel may be supplied to the prefilmer using an annular gallery. Such a gallery supplies a circumferential (i.e. non-discrete) film of fuel onto the prefilmer, and thus creates a uniform circumferential distribution of fuel.

In certain applications, it is desirable to use an injector comprising discrete fuel sources as described above. In order to obtain a circumferential distribution comparable to that provided by an annular gallery, it is desirable to use a larger number of discrete jets. However, there is a limit on the minimum jet hole size in order to prevent blockage from debris and fuel cracking (oxidative coking). Consequently, this limits the number of jets which can fit around the circumference of the injector and also limits the uniformity of the circumferential distribution of the fuel film on the prefilmer.

Accordingly, the present invention seeks to provide a discrete fuel source-type injector which has a more uniform circumferential fuel distribution.

STATEMENTS OF INVENTION

In accordance with an aspect of the invention, there is provided a fuel injector comprising: a prefilmer; a plurality of discrete fuel sources each arranged to supply fuel to a surface of the prefilmer; wherein the prefilmer comprises a circumferential dispersion structure which, in use, spreads the fuel in a circumferential direction as it passes from an impingement point on the surface of the prefilmer to a downstream edge of the prefilmer.

The present invention may provide a more uniform fuel distribution at the downstream edge of the prefilmer.

This may allow the fuel injector to use a smaller number of discrete fuel sources. Consequently, the construction of the fuel injector may be simpler resulting in reduced manufacturing cost. Furthermore, the fuel injector may be more reliable since there are fewer fuel sources which may become blocked. In addition, using fewer fuel sources may allow the sources to be located at a lower radius. This may reduce the heat load to the fuel wetted transport passages and reduce the risk of coking.

Alternatively or in addition, the improved fuel distribution may allow the prefilmer to be made shorter. This may therefore lead to the fuel injector and surrounding components being shorter, lighter and cheaper to manufacture.

The circumferential dispersion structure may comprise one or more surface formations.

The circumferential dispersion structure may comprise a plurality of radially convex portions (i.e. ribs) spaced around the circumference of the prefilmer and separated from one another by a plurality of troughs (i.e. flutes).

Each discrete fuel source may be arranged so that the impingement point on the surface of the prefilmer is located at a peak of one of the convex portions.

The convex portions and troughs may extend from the impingement point to the downstream edge.

The convex portions and troughs may taper such that the cross-section of the prefilmer approaches circular towards the downstream edge of the prefilmer.

The cross-section of the prefilmer at the downstream edge may be circular.

The circumferential dispersion structure may comprise a plurality of protruding walls (i.e. ribs) or recessed channels (i.e. flutes) which channel the fuel toward a circumferential direction.

Each protruding wall or recessed channel may form a U-shaped profile or a V-shaped profile.

The impingement point may be located at the centre of the U-shaped profile or the V-shaped profile.

The plurality of protruding walls or recessed channels may be grouped together in sets of protruding walls or recessed channels, with each set comprising a plurality of protruding walls or recessed channels fanning from the impingement point.

The circumferential dispersion structure may be asymmetric.

The discrete fuel sources may be fuel supply slots or fuel supply jets.

The discrete fuel source may form a pilot injector or a main injector.

The fuel injector may be used in a gas turbine engine.

BRIEF DESCRIPTION OF THE DRAWINGS

For a better understanding of the present invention, and to show more clearly how it may be carried into effect, reference will now be made by way of example, to the following drawings, in which.

DETAILED DESCRIPTION

Figure 1:
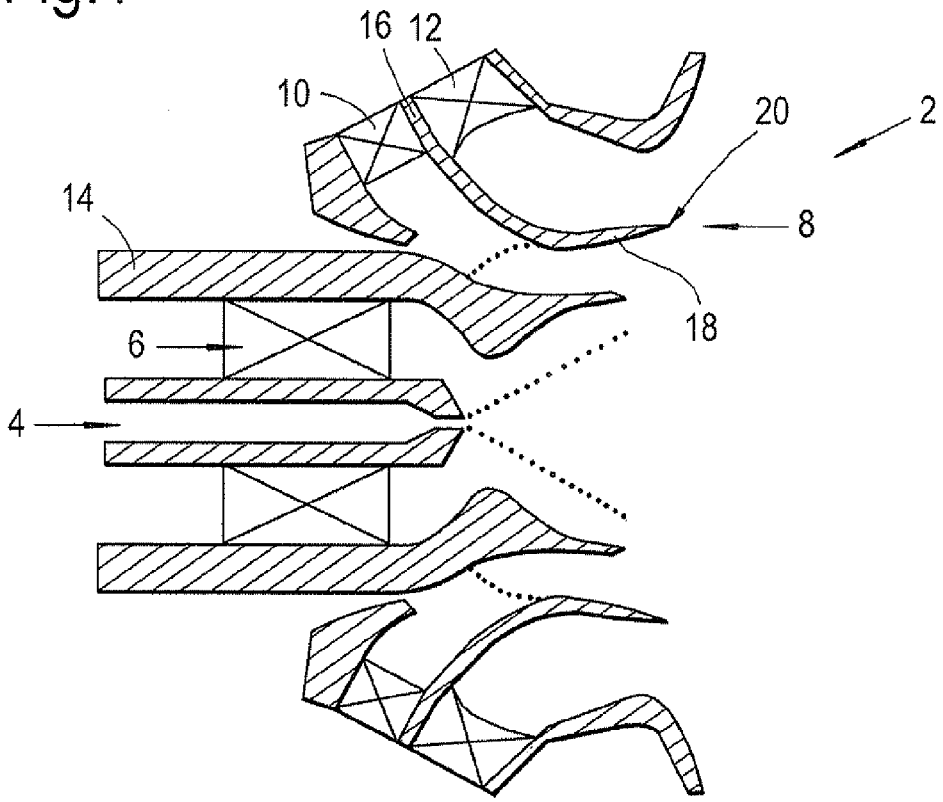
FIG. 1 is a cross-sectional view of a conventional fuel injector in an axial direction.
Figure 2:
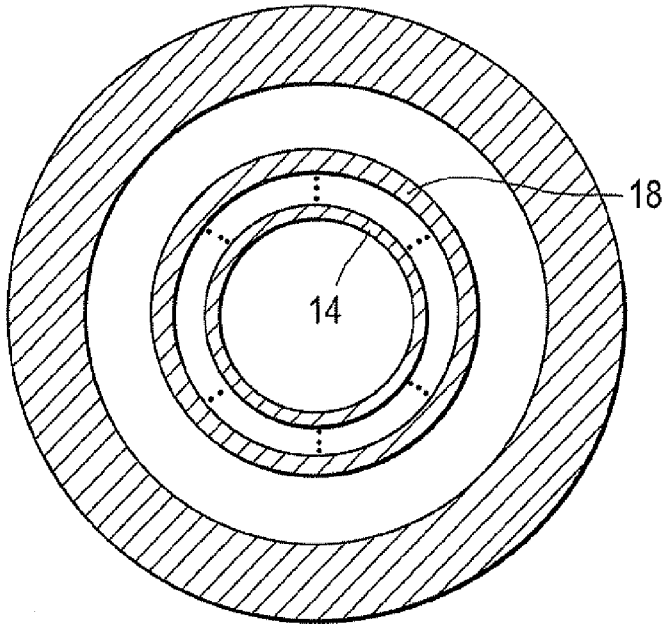
FIG. 2 is a cross-sectional view of the fuel injector of FIG. 1 in a radial direction.
Figure 3:
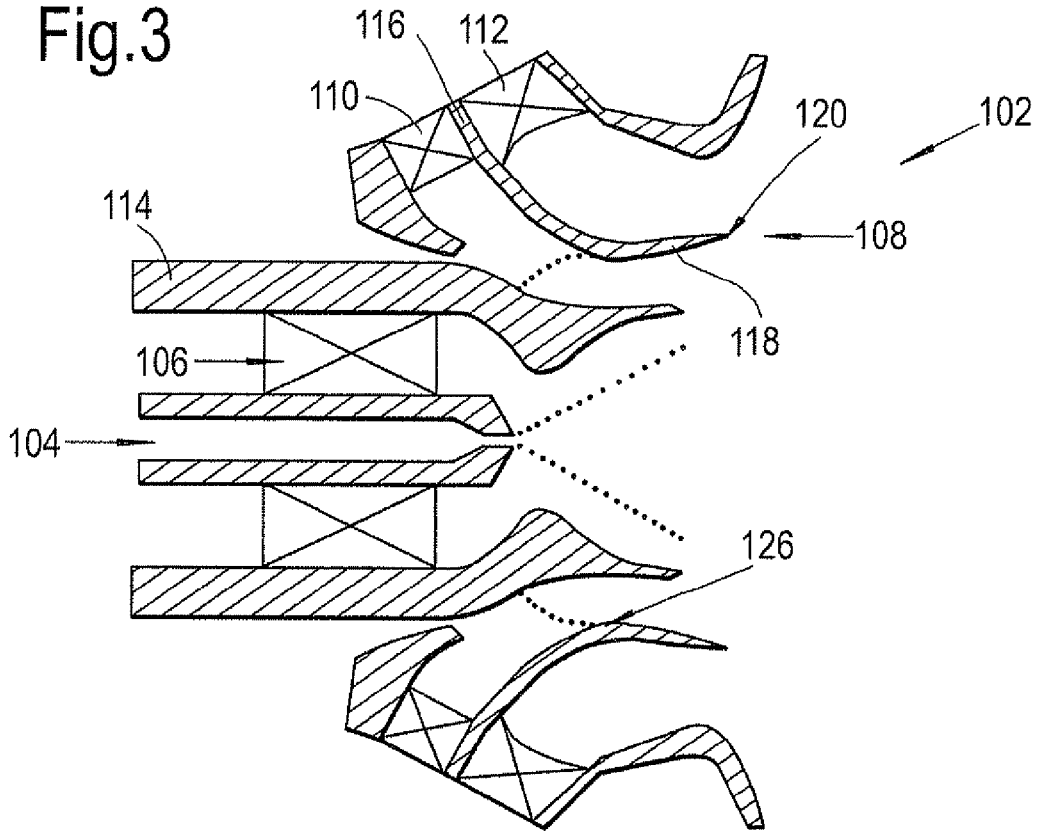
FIG. 3 is a cross-sectional view of a fuel injector in accordance with an embodiment of the invention in an axial direction.
Figure 4:
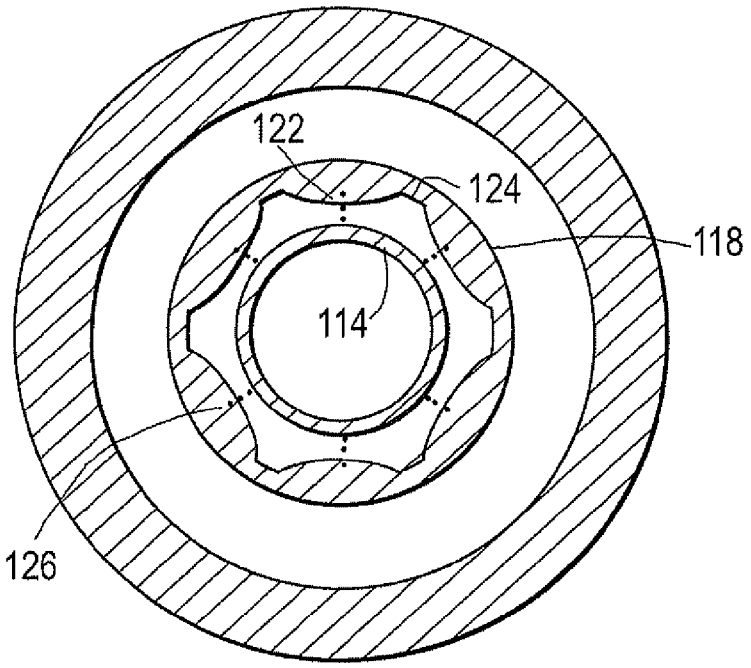
FIG. 4 is a cross-sectional view of the fuel injector of FIG. 3 in a radial direction.

With reference to FIGS. 3 and 4, a fuel injector 102 in accordance with an embodiment of the invention comprises a pilot injector 104 and a pilot swirler 106 for swirling air past the pilot injector 104. A main injector 108 is concentrically positioned around the pilot injector 4 and the pilot swirler 106. An inner main swirler 110 and an outer main swirler 112 are disposed on concentrically inner and outer sides of the main injector 108.

An inner annular member 114 is located between the pilot swirler 6 and the inner main swirler 110. Similarly, an outer annular member 116 is located between the inner main swirler 110 and the outer main swirler 112.

The main injector 108 comprises a plurality of discrete fuel sources which are spaced around the circumference of an outer surface of the inner annular member 114 (not shown). As indicated by the dashed lines, the fuel sources direct jets of fuel towards an inner surface of the outer annular member 116, which forms a prefilmer 118.

The fuel flows over the surface of the prefilmer 118 prior to being shed from a downstream edge 120 into the swirling airflows. This allows effective atomisation of the fuel.

As shown in FIG. 4, the prefilmer 118 has a generally cylindrical cross-section defined by a plurality of radially convex portions 122 separated from one another by a plurality of troughs 124. This profiled shape of the prefilmer 118 acts as a circumferential dispersion structure, as will be described in more detail below.

The discrete fuel sources are arranged such that the jets of fuel contact the prefilmer 118 at peaks of the convex portions 122, as indicated by impingement point 126. Accordingly, the convex portions 122 cause the fuel to be dispersed from the impingement point 126 in a circumferential direction towards the adjacent troughs 124. The convex portions 122 therefore create a more uniform circumferential fuel distribution at a downstream edge 120 of the prefilmer 118.

The cross-section of FIG. 4 is taken through an upstream portion of the prefilmer 118 at or adjacent to the impingement point 126. The convex portions 122 and troughs 124 may extend from the upstream portion to the downstream edge 120. Alternatively, the convex portions 122 and troughs 124 may taper such that the cross-section of the prefilmer 118 transitions to circular towards the downstream edge 120, with the cross-section of the prefilmer 118 being circular at the downstream edge 120.

Figure 5:
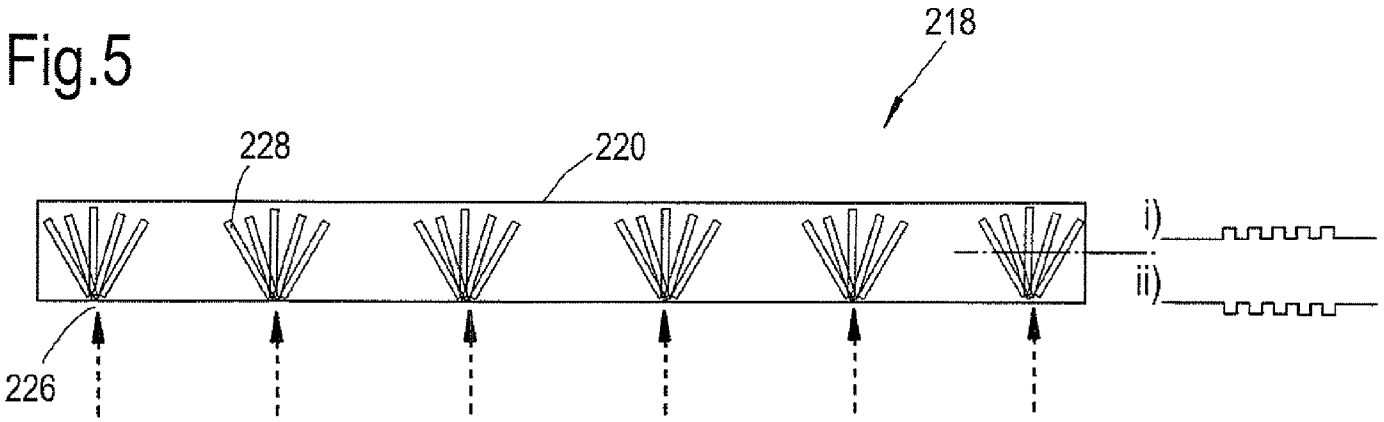
FIG. 5 is a developed view of a prefilmer in accordance with another embodiment of the invention.

FIG. 5 shows another embodiment of a prefilmer 218 which uses an alternative circumferential dispersion structure.

In this embodiment the circumferential dispersion structure comprises a plurality of walls or channels 228 which channel the fuel in a circumferential direction. Where a plurality of walls are used, these protrude from the surface of the prefilmer 218 (as shown in cross-section (i) of FIG. 5). On the other hand, where a plurality of channels are used, these are recessed into the body of the prefilmer 218 and thus lie below the surface of the prefilmer 218 (as shown in cross-section (ii) of FIG. 5).

The plurality of walls or channels 228 are grouped together in sets, with each set comprising a plurality of walls or channels 228 fanning from (or a point adjacent to) the impingement point 226 on the surface of the prefilmer 218. In other words, in each set the walls or channels 228 have ends which are collocated at a point, and which extend from this point towards the downstream edge 220 at different angles.

Accordingly, the fuel enters channels formed between adjacent walls 228 or the channels 228 themselves at the impingement point 226. The fuel is directed by the walls or channels 228 in order to disperse the fuel in the circumferential direction as it passes over the prefilmer 218 to the downstream edge 220. At the downstream edge 220, the fuel has been dispersed to create a more uniform circumferential fuel distribution, thus occupying the voids between adjacent fuel jets.

Figure 6:
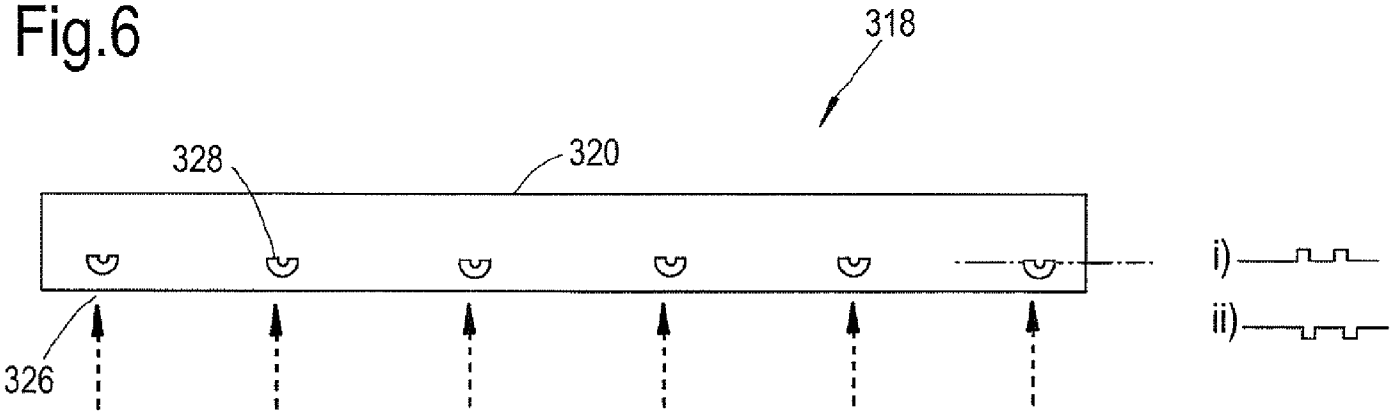
FIG. 6 is a developed view of a prefilmer in accordance with another embodiment of the invention.

FIG. 6 shows another embodiment of a prefilmer 318 which uses walls or channels 328 as a circumferential dispersion structure.

In this embodiment a plurality of U-shaped walls or channels 328 are provided on the surface of the prefilmer 318. Again, where a plurality of walls are used, these protrude from the surface of the prefilmer 318 (as shown in cross-section (i) of FIG. 6), and where a plurality of channels are used, these are recessed into the body of the prefilmer 318 and thus lie below the surface of the prefilmer 318 (as shown in cross-section (ii) of FIG. 6). The walls or channels 328 are arranged such that the base of the U-shape is toward the downstream side of the prefilmer 318.

The impingement point 326 of each fuel jet is located at the centre of one of the U-shaped walls or channels 328. Accordingly, the wall or channel 328 directs the fuel away from the impingement point 326 so as to disperse the fuel in the circumferential direction as it passes over the prefilmer 318 to the downstream edge 320. At the downstream edge 320, the fuel has been dispersed to create a more uniform circumferential fuel distribution, thus occupying the voids between adjacent fuel jets.

Although the walls or channels 328 have been described as being U-shaped, they could alternatively have a V-shaped profile or other shape which disperses the fuel in a circumferential direction.

The present invention may alternatively employ a series of discrete slots located around the circumference of the prefilmer 118, 218, 318 to place fuel onto the surface of the prefilmer 118, 218, 318. Accordingly, the term "impingement point" may have width, but the fuel sources still provide discrete supplies of fuel to the circumferential dispersion structure.

Although shown as being symmetrical, the circumferential dispersion structure provided by the convex portions 122 and troughs 124, and walls or channels 228, 328 may alternatively be asymmetric in order to allow fuel impingement on the prefilmer with a swirl angle.

Although the invention has been described with reference to a prefilmer for a main injector, it could also be applied to a prefilmer for a pilot injector.

The invention claimed is:

1. A fuel injector comprising:

a circumferential dispersion structure which, in use, spreads fuel in a circumferential direction; the circumferential dispersion structure comprising a first surface which is an outer surface of an inner annular member, and a second surface which is an inner surface of an outer annular member, the inner annular member and the outer annular member being arranged in co-axial alignment;

a plurality of discrete fuel sources spaced around a circumference of one of the first surface or the second surface; and a plurality of radially convex portions spaced around a circumference of the other one of the first surface or the second surface, the plurality of radially convex portions being separated from one another by a plurality of troughs and defining a prefilmer, wherein the plurality of discrete fuel sources and the plurality of radially convex portions are arranged with respect to each other such that jets of fuel emerging from the discrete fuel sources impinge at peaks of the plurality of radially convex portions, whereby the plurality of radially convex portions cause the fuel to be dispersed from points of impingement at the peaks in the circumferential direction towards adjacent ones of the plurality of troughs.

2. The fuel injector as claimed in claim 1, wherein the plurality of radially convex portions and the plurality of troughs extend from the impingement points to a downstream edge of the prefilmer.

3. The fuel injector as claimed in claim 1, wherein the plurality of radially convex portions and the plurality of troughs taper such that a cross-section of the prefilmer approaches circular towards a downstream edge of the prefilmer.

4. The fuel injector as claimed in claim 3, wherein the cross-section of the prefilmer at the downstream edge is circular.

5. The fuel injector as claimed in claim 1, wherein the circumferential dispersion structure is asymmetric.

6. The fuel injector as claimed in claim 1, wherein the discrete fuel sources are selected from the group consisting of fuel supply slots and fuel supply jets.

7. The fuel injector as claimed in claim 1, wherein the discrete fuel sources form an injector selected from the group consisting of a pilot injector and a main injector.

8. A gas turbine engine comprising the fuel injector as claimed in claim 1.

9. The fuel injector as claimed in claim 1 wherein the plurality of discrete fuel sources is provided in the first surface and the plurality of radially convex portions is provided on the second surface.

10. A fuel injector comprising:

a plurality of discrete fuel sources arranged to dispense fuel at an outer surface of an inner annular wall and supply the fuel to a surface of a prefilmer provided on an inner surface of an outer annular wall; wherein a surface of the prefilmer comprises a circumferential dispersion structure which, in use, spreads the fuel in a circumferential direction as it passes from an impingement point on the surface of the prefilmer to a downstream edge of the prefilmer, the circumferential dispersion structure comprises a plurality of radially convex portions spaced around a circumference of the surface of the prefilmer and separated from one another by a plurality of troughs, and the plurality of discrete fuel sources and the plurality of radially convex portions are arranged with respect to each other such that jets of fuel emerging from the discrete fuel sources impinge at peaks of the plurality of radially convex portions, whereby the plurality of radially convex portions cause the fuel to be dispersed from the points of impingement at the peaks in a circumferential direction towards adjacent ones of the plurality of troughs.

11. A fuel injector comprising:

a circumferential dispersion structure which, in use, spreads fuel in a circumferential direction, the circumferential dispersion structure comprising a first surface which is an outer surface of an inner annular member, and a second surface which is an inner surface of an outer annular member, the inner annular member and the outer annular member being arranged in co-axial alignment;

a plurality of discrete fuel sources spaced around a circumference of one of the first surface or the second surface; and a plurality of protruding walls or a plurality of recessed channels grouped together in sets, the sets of the grouped plurality of protruding walls or the grouped plurality of recessed channels being configured and arranged to channel the fuel toward a circumferential direction, the sets of the grouped plurality of protruding walls or the grouped plurality of recessed channels being spaced around a circumference of the other one of the first surface or the second surface and defining a prefilmer, wherein the plurality of discrete fuel sources and the sets of the grouped plurality of protruding walls or the grouped plurality of recessed channels are arranged with respect to each other such that jets of fuel emerging from the plurality of discrete fuel sources impinge at a respective plurality of convergences of the sets of the grouped plurality of protruding walls or the grouped plurality of recessed channels, each set of the grouped plurality of protruding walls or the grouped plurality of recessed channels fanning from a point of impingement at the convergence, whereby the sets of the grouped plurality of protruding walls or the grouped plurality of recessed channels cause the fuel to be dispersed from the points of impingement at the convergences in a circumferential direction.

12. The fuel injector as claimed in claim 11, wherein each set of grouped recessed channels forms a U-shaped profile or a V-shaped profile.

13. The fuel injector as claimed in claim 11, wherein each set of grouped protruding walls forms a U-shaped profile or a V-shaped profile.

14. The fuel injector as claimed in claim 13, wherein the impingement point is located at the center of the U-shaped profile or the V-shaped profile.

* * * * *